US007878076B2

(12) United States Patent
Lucke et al.

(10) Patent No.: US 7,878,076 B2
(45) Date of Patent: Feb. 1, 2011

(54) TORQUE TOOL WITH POWER AMPLIFIER

(75) Inventors: Michael Lucke, Wuppertal (DE); Joachim Wilhelm, Wuppertal (DE)

(73) Assignee: Eduard Wille GmbH & Co. KG, Wuppertal (DE)

( * ) Notice: Subject to any disclaimer, the term of this patent is extended or adjusted under 35 U.S.C. 154(b) by 11 days.

(21) Appl. No.: 11/725,590

(22) Filed: Mar. 19, 2007

(65) Prior Publication Data

US 2007/0227316 A1 Oct. 4, 2007

(30) Foreign Application Priority Data

Mar. 20, 2006 (DE) ..... 10 2006 013 148

(51) Int. Cl.
*F41B 11/00* (2006.01)
*B25B 23/144* (2006.01)
*B25B 23/155* (2006.01)

(52) U.S. Cl. ..... 73/862.23; 73/862.21; 73/862.22; 81/478; 81/479; 124/77

(58) Field of Classification Search . 73/862.21–862.27; 124/77; 81/478–479
See application file for complete search history.

(56) References Cited

U.S. PATENT DOCUMENTS 3,201,981 A * 8/1965 Barnard ..... 73/862.08
5,572,735 A * 11/1996 Tanikawa ..... 320/166
6,119,562 A 9/2000 Jenkins
6,167,788 B1 1/2001 Schonberger et al.
6,526,853 B2 3/2003 Jenkins
6,826,365 B1 * 11/2004 Constable ..... 396/206
6,832,605 B2 * 12/2004 Farrell ..... 124/76
2002/0152849 A1 10/2002 Jenkins
2003/0214270 A1 * 11/2003 Shiue et al. ..... 320/166
2006/0185657 A1 * 8/2006 Gabrel ..... 124/73
2006/0241655 A1 * 10/2006 Viola ..... 606/142
2007/0107557 A1 * 5/2007 Pettit ..... 81/56
2008/0275471 A1 * 11/2008 Viola ..... 606/142

FOREIGN PATENT DOCUMENTS

DE 196 37 067.1 9/1996
DE 199 12 837 10/2000
DE 100 51 011 4/2002
DE 102 26 134 12/2003
DE 20 2004 019 297 3/2005

* cited by examiner

*Primary Examiner*—Lisa M Caputo
*Assistant Examiner*—Jonathan Dunlap
(74) *Attorney, Agent, or Firm*—Lawrence G. Fridman

(57) ABSTRACT

A torque tool for measuring and/or cut-off tightening of a torque on a workpiece. The torque tool is provided within a housing with a handle. The torque to be measured is transmitted with a rod. A measuring element electronically detects the actual torque. A measure- and control electronics for processing the torque detected in such a way. The electronic measure and control electronics controls a cut-off switch for cutting-off the torque tool.

22 Claims, 4 Drawing Sheets

TORQUE TOOL WITH POWER AMPLIFIER

FIELD OF THE INVENTION

The invention relates to a torque tool for measuring and/or cut-off tightening of a torque on a workpiece.

BACKGROUND OF THE INVENTION

Screwed connections are very common connections in engineering. Such connections can require the use of suitable assembly tools. Torque tools as they are described above are assembly tools suitable for this purpose. Torque tools are necessary to exert a certain torque to a workpiece. Examples for such torque tools are torque wrenches or torque screw drivers.

The torque transferred when a manually operated tool is used depends on the physical constitution of the user as well as his own power sensitivity therein. Torque tools are used to bias a screw with a high biasing power in the elastic region of the screw or to bias a screw with only small biasing powers. The use of new construction materials such as, for example, magnesium, alumina or plastics especially in automotive engineering or aircraft industry increases the need for torque tools as well as the requirements thereon. Due to the new materials the amount of sensible screwed connections increases. The smaller tensile strength of such lightweight materials compared to steel materials would cause damaging of the thread when overstraining the screwed connection, such damaging making the expensive components useless.

German patent publication DE 100 51 011 A1 discloses a cut-off torque wrench electronically detecting the torque. The mechanical torque is converted into an electronic signal with a strain gauge. The torque detected in such a way is compared to a set value. If the measured torque reaches the adjusted or given torque set value the torque wrench is mechanically released for at least a short time by the electronic result. The cut-off is affected, for example, by de-coupling of the wrench handle from the wrench head. The document proposes that the coupling is provided in the form of a magnetic coupling with electric magnets where the magnets are switched off for de-coupling. Alternatively a plug element in a corresponding plug-in connection connects the wrench head with the wrench handle. The fixed coupling the plug-in connection is released by magnetic force, so that the wrench head can pivot over.

In the German patent publication DE 199 12 837 C2 an electronic measuring and cut-off torque wrench is described also. With this torque wrench a torque sensor detects the actual torque. A control device finally compares the measured value with a set value the adjusted set value being obtained from the analysis of the respective workpiece. The analysis of the workpiece is directly affected by means of a workpiece identification device. If the actual value reaches the set value, the torque wrench is cut off. A ferromagnetic locking bolt locks into, for example, a torque rod along the longitudinal axis. For this purpose the torque rod is provided with a suitable locking recess. In order to cut off the torque wrench a magnetic coil surrounding the locking bolt is energized in such a way, that the ferromagnetic locking bolt is released against a spring power from the locking recess. The spring power serves the purpose of returning the locking bolt after cut-off to its original state.

The known torque wrenches have the disadvantage, that the electrically controlled locking mechanisms used in the prior art have high energy consumption. This is the case due to the use of coils for the electric magnets high energy consumers are integrated into the torque wrenches. Only relatively few or no cut-offs of a torque wrench can be carried out with common batteries or accumulators. The locking bolts, however, must be designed sufficiently large in order to prevent instant deforming with the applied torque. For each cut-off this locking bolt must be moved. The coils of the electro magnet, therefore, must be provided with the corresponding electric power in order to move the locking bolt against a power acting against the locking mechanism and against a spring power.

SUMMARY OF THE INVENTION

It is, therefore, an object of the invention to optimize the power requirements of an electronic controlled torque tool to reduce the energy consumption. Thereby the amount of cut-offs of the torque wrench, especially with common batteries or accumulators, also, shall be increased or be made possible at all.

According to one aspect, the invention proposes a torque tool for measuring and/or cut-off tightening of a torque on a workpiece of the above mentioned kind in that a power and/or voltage amplifier is provided for amplifying the mechanical and/or electrical power or voltage, respectively, for the electronically or mechanically controlled cut-off switch.

A high power is required for the cut-off of a torque tool, in order for the cut-off switch to carry out the cut-off. Practically, this power cannot be provided by common batteries or rechargeable accumulators. It is, of course, possible to connect a torque tool to the power network with a cable to obtain the desired power. However, this would mean that the torque tool cannot be freely used anymore. A power socket is always required. As the power is required only for a very short moment, i.e. the moment where the torque tool cuts off, according to the invention for this purpose a power and/or voltage amplifier is proposed for the amplification of the mechanical and/or electrical power or voltage, respectively for the electronically or mechanically controlled cut-off switch. Thereby it is achieved that the required power to cut-off a torque tool is present, which cannot be provided by common batteries or accumulators in the desired form. The required power is often needed only for a split second. It is, therefore, advantageous to amplify the power of the battery or accumulator with a power amplifier.

A fast discharging capacitor is possible as an electric power amplifier. This capacitor can be charged relatively slowly with a battery or an accumulator. By the quick discharging of the capacitor a sufficiently high power peak is obtained which is required to switch the cut-off switch. In the case of a mechanical solution mechanical power amplification, such as a biased spring is advantageously possible.

In a preferred modification of the torque tool according to the invention the electronically controlled cut-off switch is a magnetic switch. The magnetic switch can be electronically controlled in a simple manner, for example by electromagnets.

According to a preferred embodiment of the torque tool according to the invention the electronically controlled cut-off switch is a piezo switch. Also, the electronic control can be relatively easily realized with such a switch. By applying an electric voltage a piezo crystal is deformed in such a switch. This initiates the switching process.

Further advantageous embodiments of the present invention are achieved in that the cut-off switch is a hydraulic, pneumonic and/or pneumatic switch. Thereby further preferred switching alternatives for the cut-off switch for an advantageous realization of the torque tool according to the present invention are provided.

A further advantageous alternative for the above mentioned cut-off switches can be achieved in that the cut-off switch comprises an electric motor. With a suitable electric motor, such as a stepper motor, the cut-off switch can be also controlled and cut off in a particularly simple way. Furthermore, such a cut-off switch can be easily returned to its initial position without the need of further construction measures, such as spring based measures.

According to a further advantageous modification of the present invention means are provided for detecting a rotational angle. Thereby also the rotational angle can be detected in addition to the torque of the torque tool. Preferably, there are provided such means for cutting-off the torque tool at a set value for the rotational angle, also.

According to a preferred alternative of the torque tool according to the present invention an actuating means is provided for setting the torque or the rotational angle, respectively, where the torque tool is cut off. The actuating means may, for example, be a controller or a keyboard used to insert the set values for the torque tool.

Furthermore, an advantageous embodiment of the torque tool according to the present invention is achieved in that means for comparing an actual value to a set value are provided. Only the comparison of the actual value with the set value will make a cut-off of the torque tool reasonably. Preferably the comparison is affected in an electronic control circuit which finally can also control the cut-off switch.

In order to ensure, that the user of such a torque tool knows, which actual torque and/or rotational angle is present, an optical and/or acoustic display is provided. The display may also be a vibrational signal generator. The display or signal generator, respectively, not only serve to display a value but also to alarm the user at a set torque. Furthermore, the display serves to support the user when he is adjusting the set value.

Furthermore, an advantageous embodiment of the torque tool according to the present invention is achieved by transmission means. These transmission means serve to adjust the set value for a torque and/or for the transmission of measured data from a distance. Thereby, for example, the set values for torque tools can be adjusted with an external device. In the same way the measured data or measuring protocols can be transmitted to an external evaluation device. The torque tool is basically set up for a data exchange with an external device. Preferably, the transmission means are radio and/or infrared transmission means and/or a cable interface. Common standards for radio connections, such as "Bluetooth" or "WLAN" enable small production costs. The cable connections can preferably be electric cables, however, they may also be optic fibers to provide a connection to the external device.

According to a preferred embodiment of the torque tool according to the present invention a gear mechanism is provided. The gear mechanism is provided with at least one actuator operated by the cut-off switch. Therein, the gear mechanism is arranged between the rod for transmitting the torque and the electronically controlled cut-off switch to cut-off the torque tool. Due to the gear mechanism only a small power is necessary to cut-off such a torque tool. The magnetic switch can, therefore, be designed with much smaller diameters, as it is the case with torque tools according to the prior art having a locking bolt. The electric power required by a voltage supply which is needed to activate the cut-off switch is reduced by the smaller power consumption of the cut-off switch. Thereby the actuator operated by the cut-off switch can be designed with smaller diameters as it is necessary without a gear mechanism. The power consumption which is normally very high which is necessary to move the relatively largely designed locking bolt is now compensated to a large extent by the gear mechanism. Due to the smaller power consumption much more cut-offs of the torque tool can be performed as it was previously the case.

According to a preferred embodiment of a torque tool according to the present invention the gear mechanism comprises a gearshift with a switching edge controlled by the electronically controlled cut-off switch. By this measure it is achieved that the gear mechanism is provided with a gearshift with a switching edge, which may also be a rod cutting off the torque tool. In order to obtain small friction between the actuator and the gearshift a suitable low-friction switching edge is provided at the gearshift. The gearshift can also be biased by, for example, a spring.

Preferred modifications which may be used with a torque tool according to the present invention are achieved in that the gear mechanism controlled by the electronically controlled cut-off switch acts on a bent lever, an inclined cube or on a cam plate. By these measures the torque tool is cut-off in a preferred way.

According to a further advantageous embodiment of a torque tool according to the present invention the gear mechanism is provided with at least one gear lever operated by a gearshift. The force which must be activated to cut-off the torque tool is reduced according to the gear ratio by the gear lever. Therein, the gear lever can be, for example, biased by a spring.

In a further, particularly advantageous embodiment of the torque tool according to the present invention a roll, a ball and/or a self-locking wedge is provided between a gearshift and a gear lever. By this measure it is achieved that the friction between the gearshift and the gear lever is considerably reduced. The force which must be activated for the cut-off switching process is again minimized. Preferably, the roll, ball and/or self-locking wedge is spring biased to avoid the generation of play.

It has been proven to be advantageous in one alternative of a torque tool according to the present invention, if the measuring and control electronics are processor controlled. Processors are nowadays mass products so that the electronics can be realized with such components with a relatively cheap production.

With a suitable programming such electronics may also be quickly and easily adapted to changing conditions.

According to a further advantageous embodiment of the invention storing means are provided, especially for storing a set value, measured value and/or a measuring protocol. They may be used for keeping the values for a longer period of time in the torque tool. If necessary the contents of the storing means can be downloaded. This can be affected by external devices by means of data transmission.

Preferably energy storage for intermediate storage of energy is provided. This energy storage can quickly release its energy to provide the required power for the cut-off process.

Further advantages result from the subject matter of the subclaims, as well as the drawings with the accompanying descriptions. The embodiments of the invention are described below in greater detail with reference to the drawings.

DESCRIPTION OF THE EMBODIMENTS OF THE INVENTION

Figure 1:
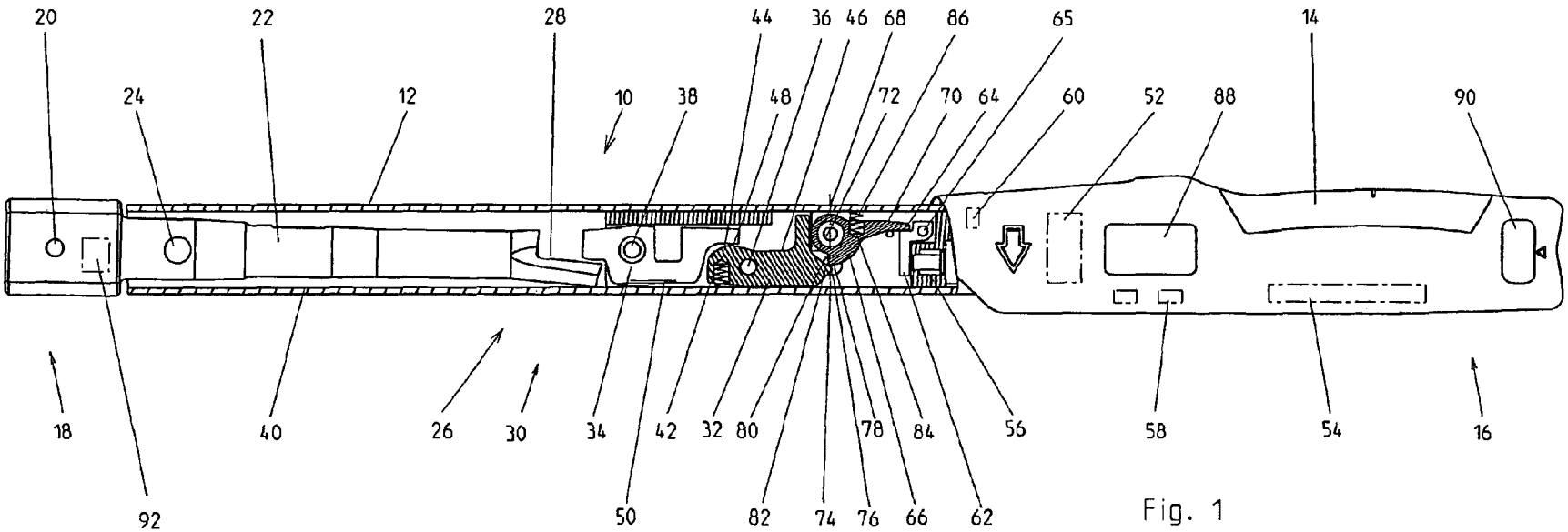
FIG. 1 is a partially sectional, elevational side view of a torque tool where the gear mechanism comprises a switching edge controlled by the electronic controlled cut-off switch.

In FIG. 1 numeral 10 denotes a torque tool. The torque tool 10 is provided with an elongated housing 12 with a handle 14 at the end 16 of the housing 12. A tool receptacle 20 is provided at the other end 18. Exchangeable plug- or insert tools can be mounted in the tool receptacle 20. Plug- or insert tools serve to receive workpieces where the torque and/or the rotational angle must be determined.

A head lever 22 is supported around a pin 24 in the housing 12. The head lever 22 is essentially an elongated rod transmitting the torque. The tool receptacle 20 is connected to the head lever 22 at the end 18. A step edge 28 is provided at the other end of the head lever 22. The head lever 22 is pivotably connected to a gear mechanism 30.

The gear mechanism 30 comprises a first gear lever 32 and a second gear lever 34. The first gear lever 32 is supported by a first bearing pin 36 and the second gear lever by a bearing pin 38. The first gear lever 32 is provided with a bore hole 42 on the lower side which is directed towards the housing wall 40 of the housing 12. A helical spring 44 supported on the housing wall 40 is in the bore hole 42 and biasing the first gear lever 32.

The first gear lever 32 is provided with a step edge 46 pivotably connected to a projection edge 48 of the second gear lever 34. The head lever 22, the first and the second gear levers 32, 34 are engagingly mounted.

A measuring element 50 is arranged at the second gear lever 34 detecting the respective torque. Preferably the measuring element 50 is a strain gauge converting the respective torque into a corresponding electric signal. This electric signal is forwarded to a measuring and control electronics 52 for processing and detecting the respective actual torque as an actual value. The measuring and control electronics 52 is in the housing 12 in the range of the handle 14. Also, there is a voltage supply 54 in the form of re-chargeable accumulators. The voltage supply 54 supplies an electrically controlled cut-off switch in addition to the measuring and control electronics.

The measuring and control electronics 52 comprises a processor and a storage, which, for purposes of simplicity are not shown in the present figure. The torques determined with the measuring element 50 are compared to a set value. The set value is stored in the storage of the measuring and control electronics 52. The set value can be manually entered by means of an operating device in the form of the insertion unit 58. The insertion unit 58 is, for example, a keyboard or a turning knob.

The comparison of the respective actual value with the set value is carried out by the processor. For this purpose the processor processes the corresponding routine. If the actual value corresponds to the set value the electronic measuring and control electronics 52 generates a cut-off signal which is forwarded to the cut-off switch 56 by the power amplifier 60. The cut-off switch 56 is an electric magnet in the present embodiment. Different alternatives of a switch, such as a piezo switch, hydraulic, pneumonic and/or pneumatic switches are also possible to realize such a torque tool 10. If applicable, the switching process can be carried out by an electric motor, also. Such a cut-off switch 56 has a high power consumption requirement, even if this is the case only during the cut-off process. This power consumption cannot be covered by common accumulators. The power amplifier 60 provides sufficient power to carry out the switching process of the cut-off switch 56.

If the cut-off switch 56 is switched by the measuring and control electronics 52 it acts, first of all, on a diverting lever 62. The diverting lever 62 is provided with a step 64 at its upper end. By operating the cut-off switch 56 the diverting lever 62 moves around a bearing pin 65 and drives a switching lever 66. The switching lever 66 consists of a round head end 68 and an elongated lever end 70. Thereby the switching lever 66 is moved about a bearing pin 72 during operation. The bearing pin 72 is positioned on a vertical axis 74 intersecting a step 76 at an edge 78 of the first gear lever 32. The bearing pin 72 is arranged in the range of the round head end 68. The round head end 68 is provided with a notch-shaped recess 80 generated by two segments of a circle having different radii, whereby a switching lever edge 82 is formed.

On the upper side of the switching lever 66 is a bore hole 84. A helical spring 86 is in the bore hole 84 supported on the inner wall of the housing 12 and biasing the switching lever 66.

During the switching process of the cut-off switch 56 the longitudinal lever end 70 of the switching lever 66 is moved upwardly by the diverting lever 62 counter clockwise around the bearing pin 72. The edge 78 of the first gear lever 32 biased by the helical spring 42 then glides from the switching lever edge 82 into the notch-shaped recess 80. Thereby the torque tool 10 is cut-off.

A display 88 serves in particular for displaying the actual value and the adjusted set value. The display 88 is positioned in the range of the handle 14 of the torque tool 10.

Furthermore, a radio interface 90 is integrated in the range of the handle 14. The radio interface 90 is coupled to the measuring and control electronics 52. Instead of the manual entering of the set value by means of the insert unit 58 the set value may also be transmitted through the radio interface 90. The radio interface 90 also satisfies the requirements to transmit measuring values and/or measuring protocols to an external device with a suitable interface. These may also be intermediately stored in the storage of the measuring and control electronics 52, if applicable.

Furthermore, a rotational angle encoder 92 for the detection of the rotational angle is provided in the torque tool 10. The rotational angle encoder 92 transmits the respective rotational angle the workpiece has been tightened with in the form of an electric signal to the measuring and control electronics 52. The torque tool 10 can also be cut off at a determined set value of the rotational angle. The respective measured values can be directly forwarded to an external device or displayed on the display 88.

Figure 2:
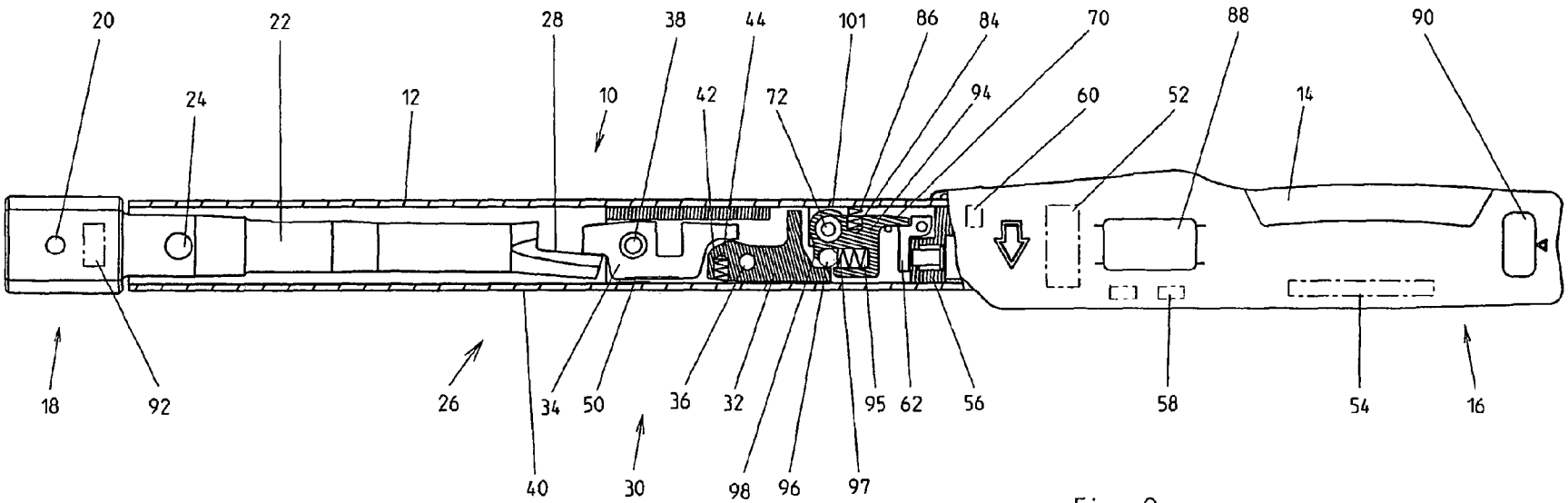
FIG. 2 is a partially sectional, elevational side view of a torque tool where the gear mechanism comprises a roll between the gearshift and a gear lever.

Regarding the basic principle the embodiment according to FIG. 2 is identically assembled as the embodiment of FIG. 1. The same components are, therefore, denoted with the same numerals. Regarding the embodiment it is, therefore, made reference to the description of FIG. 1. Only the differences shall be described below: The alternative according to FIG. 2 of the torque tool 10 according to the present invention is provided with a different gear mechanism 30. The change results from a different switching lever 94 of the gear mechanism 30. It is provided with only one opening 95. A roll 96 is positioned in the opening 95 biased with a spring 97. In order to avoid that the roll jumps out of the opening 97 a small projection is provided at the opening 95 preventing the jumping-out. The contact surface between the switching lever 94 at the head end 101 is not composed of a switching lever edge 82 but by a roll surface of the roll 96. By the roll the friction at the cut-off switching process is considerably reduced.

Figure 3:
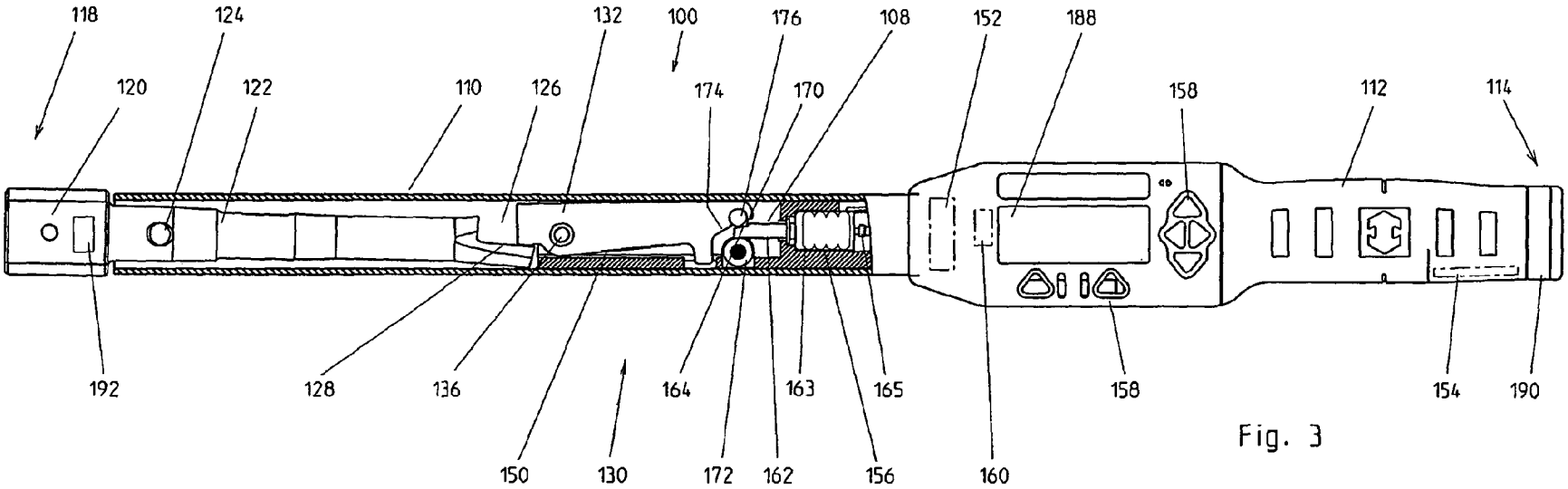
FIG. 3 is a partially sectional, elevational side view of a torque tool where the gear mechanism is driven by a self-locking wedge.

In FIG. 3 a torque tool 100 is shown where a gear mechanism 130 is pivotably connected with a self-locking wedge 108.

The torque tool 100 is provided with an elongated housing 110 with a handle 112 at one end 114 of the housing 110. A tool receptacle 120 is provided at the other end 118. Plug- or insert tools can be exchangeably mounted in the tool receptacle 120. The plug- or insert tools serve to receive workpieces where the torque and/or the rotational angle must be determined or applied.

A head lever 122 is supported in the housing 110 around a pin 124. The tool receptacle 120 is connected to the head lever 122 at the end 118. A step edge 128 is provided at the other end 126 of the head lever. The head lever 122 is pivotably connected by a gear mechanism.

The gear mechanism 130 comprises a gear lever 132. The gear lever 132 is supported by a bearing pin 136. The head lever 122 and the gear lever 132 are engagingly arranged and shaped.

A measuring element 150 is arranged at the gear lever 132, the measuring element detecting the respective torque. Preferably the measuring element 150 is a strain gauge converting the respective torque to a corresponding electric signal. This electric signal is forwarded to a measuring and control electronics 152 for processing and detecting the respective actual torque as an actual value. The measuring and control electronics 152 is positioned in the housing 110 in the range of the handle 112. There is also a voltage supply 154 in the form of re-chargeable accumulators. The voltage supply 154 supplies an electrically controlled cut-off switch 156 in addition to the measuring and control electronics 152.

The measuring and control electronics 152 comprises a processor and a storage which are not shown in the present figure. The torques determined with the measuring element 150 are compared to a set value. The set value is stored in the storage of the measuring and control electronics 152. The set value can be manually entered through a setting device in the form of an input unit 158. Keys are used for entering with the input unit 158.

The comparison of the respective actual value with the set value is carried out by the processor in the same way as the torque tool according to FIG. 1. If the actual value and the set value are the same a cut-off signal is generated by the electronic measuring and control electronics 152, the signal being forwarded to the cut-off switch 156 through the power amplifier 160. The cut-off switch 156 in the present embodiment is an electric lift magnet. The lift magnet consists of a ferrous rod 162 with a wedge-shaped end 164 and a coil 163 surrounding the ferrous rod. The ferrous rod 162 is biased by a pressure spring 165. The wedge-shaped end 164 of the ferrous rod 162 is provided with a sharp edge 170. The ferrous rod 162 is downwardly supported by a rotatably beared roll 172. The gear lever 132 is, furthermore, provided with a projection 174 having a roll 176 beared therein. The rolls 172 and 176 are perpendicular facing each other. The wedge-shaped end 164 extends between the rolls 172 and 176. A further moving of the ferrous rod 162 between the rolls 172, 176 is prevented by the sharp edge 170. The torque tool 110 is cut off by pulling back the ferrous rod 162 against the spring power of the pressure spring 165 in the direction of the handle 112. The gear lever 132 moves clockwise around the bearing pin 136 and interrupts the force application for transmitting the torque to the head lever 122.

A display 188 serves in particular to display the actual value and the adjusted set value. For this purpose the display 188 is positioned in the range of the handle 112 of the torque tool 110.

Furthermore, a radio interface 190 is integrated into the range of the handle 112. The radio interface 190 is coupled to the measuring and control electronics 152. Instead of the manual input of the set value by the input unit 158 the set value may also be transmitted through the radio interface 190. The radio interface 190 also satisfies the requirements to transmit measured values and/or measuring protocols to an external device with a corresponding interface. These may also be intermediately stored in the storage of the measuring and control electronics 152 if necessary.

Furthermore, a rotational angel encoder 192 for detecting the rotational angle is provided in the torque tool 100. The rotational angle encoder 192 transmits its respective rotational angle tightened at the workpiece in the form of an electric signal to the measuring and control electronics 152. The torque tool 110 may be cut off at a set value of the rotational angle also. The respective measured values can be directly forwarded to an external device through the radio interface 192 or they can be displayed on the display 188.

Figure 4A:
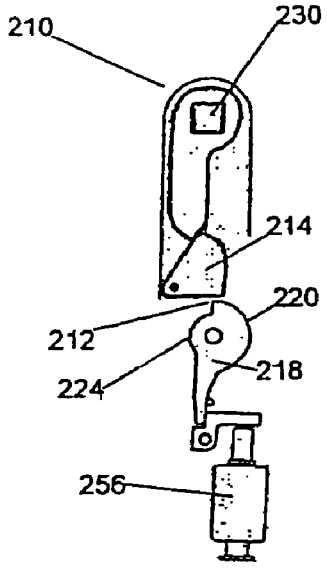
FIGS. 4*a* and 4*b* show a torque tool where the cut-off switch for cutting off acts on a switching edge.
Figure 4B:
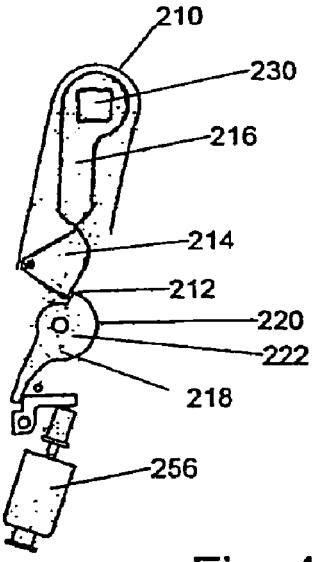

FIG. 4*a* and FIG. 4*b* each show a section of a torque tool 210 where a cut-off switch 256 is effective on a switching edge 212 to cut off. In FIG. 4*a* a situation is shown, where the torque tool 210 is not cut off. In FIG. 4*b* a situation is shown, where the torque tool is cut off. A tool receptacle 230 is provided at the end of the torque tool 210. Plug- or insert tools can be exchangeably mounted in the tool receptacle 230. The plug- or insert tools serve to receive workpieces where the torque and/or the rotational angle must be determined or applied. A gear lever 214 acts in a head lever 216. The gear lever 214 is pivotably connected to a switching lever 218 provided with a switching edge 212. For this purpose the switching lever 218 is provided with a head end 220 consisting of two segments 222, 224 of a circle with different radii. In a non-cut-off situation the segment 222 of a circle with the larger radius keeps the gear lever 214 of the torque tool 210, see FIG. 4*a*. In a cut-off state the gear lever slides on the segment 224 of a circle with the smaller radius. The torque tool is cut off by an electric cut-off switch activating a switch lever 218 controlling the gear lever for cutting off according to FIG. 4*b*.

Figure 5A:
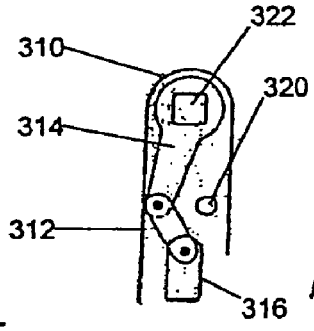
FIGS. 5*a* and 5*b* show a torque tool where the cut-off switch for cutting off acts on a bent lever.
Figure 5B:
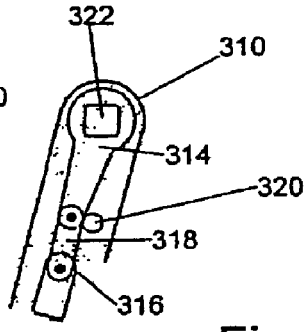

FIGS. 5*a* and 5*b* each show a section of a torque tool 310 where a cut-off switch 256 is effective on a switching lever 56 to cut off a bent lever 312. In FIG. 5*a* a situation is shown, where the torque tool 310 is not cut off. In FIG. 5*b* a situation is shown, where the torque tool 310 is cut off. A head lever 314 is connected to a gear mechanism 316 through a pivot arm 318. In a non-cut-off state according to FIG. 5*a* the distance between the gear mechanism 316 and the head lever 314 is short. A knee-shaped joint is formed. In a cut-off state the distance is increased so that the pivot arm 318 extends up to a stopper pin 320. A tool receptacle 322 is provided at the end of the torque tool 310. Plug- or insert tools can be exchangeably mounted in the tool receptacle 322. The plug- or insert tools serve to receive workpieces where the torque and/or the rotational angle must be determined or applied.

Figure 6A:
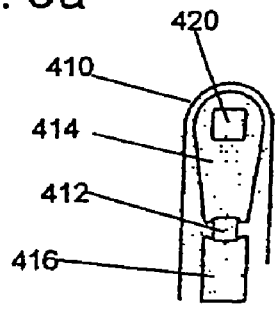
FIGS. 6*a* and 6*b* show a torque tool where the cut-off switch for cutting off acts on an inclined cube.
Figure 6B:
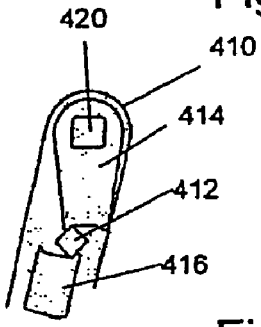

FIGS. 6*a* and 6*b* each show a torque tool where the cut-off switch is effective on an inclined cube 412 to cut off. In FIG. 6*a* a situation is shown, where the torque tool 410 is not cut off. In FIG. 6*b* a situation is shown, where the torque tool 410 is cut off. A tool receptacle 420 is provided at the end of the torque tool 410. Plug- or insert tools can be exchangeably mounted in the tool receptacle 420. The plug- or insert tools serve to receive workpieces where the torque and/or the rotational angle must be determined or applied. The inclined cube 412 is positioned between a head lever 414 and a gear lever 416 of the torque tool. In a non-cut-off state of the torque tool 410 the distance between the ends of the head lever 414 and the gear lever 416 corresponds to the side length of the inclined cube 412. The entire surface of one side of the inclined cube 412 is contacted to the head lever 414 and the gear lever 416. The head lever 414 thereby obtains a stable position on the inclined cube 412. In a cut-off state according to FIG. 6*b* the distance between the ends of the head lever 414 and the gear lever 416 is increased by a cut-off switch (not shown). Thereby the inclined cube 412 can be inclined to the cube edge as it is shown in FIG. 6*b* to cut off the torque tool.

Figure 7A:
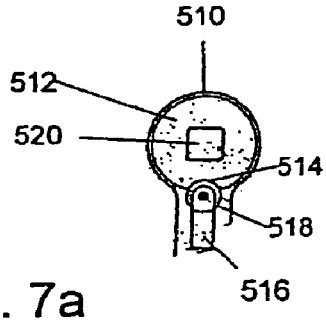
FIGS. 7*a* and 7*b* show a torque tool where the cut-off switch for cutting off acts on a cam plate.
Figure 7B:
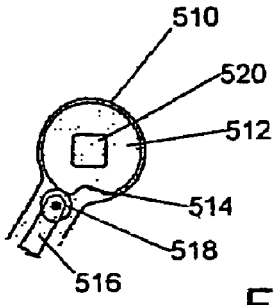

FIGS. 7*a* and 7*b* each show a torque tool 510 where the cut-off switch (not shown) is effective on a cam plate 512 to cut off. In FIG. 7*a* a situation is shown, where the torque tool 510 is not cut off and FIG. 7*b* shows a cut off situation. A tool receptacle 520 is provided at the end of the torque tool 510. Plug- or insert tools can be exchangeably mounted in the tool receptacle 520. The plug- or insert tools serve to receive workpieces where the torque and/or the rotational angle must be determined or applied. The headlever 512 is a cam plate with a recess 514. A rotatable roll 518 is arranged at the end of a gear lever 516 which is directed towards the recess 514 of the cam plate 512. The rotatable roll 518 projects into the recess 514 when the torque tool 510 is in a non cut-off state. During cut-off according to FIG. 7*b* the gear lever 516 is released whereby it can be shifted back a little. Thereby the cam plate 512 can be rotated.

What is claimed is:

1. A torque tool for measuring and/or cut-off tightening of a torque on a workpiece, comprising:

a housing having a handle;

a rod for transmitting torque;

a measuring element for electronic detection of said torque;

an electronic arrangement for measuring and controlling of processing of said torque detected by said measuring element;

a cut-off switch controlled by said electronic arrangement, said switch performing a cutting-off action when said torque reaches a predetermined level;

an electrical power amplifier for amplifying power supply required by said cut-off switch to carry out a switching process, said electric power amplifier comprises a fast discharging electrical device capable of providing a short-lasting sufficiently high electrical power peak required for energizing said cut-off switch;

a gear mechanism having at least one actuator operated by said cut-off switch and at least one gear lever, said gear mechanism is arranged between said rod for transmitting the torque and said electronically controlled cut-off switch; and wherein said measuring element is arranged on said gear lever of said gear mechanism for electronic detection of said torque.

2. A torque tool as claimed in claim 1, wherein said electronically controlled cut-off switch is a magnetic switch; said cut-off switch further requires electrical voltage and said power amplifier is also a voltage amplifier for amplifying said electrical voltage.

3. A torque tool as claimed in claim 1, wherein said electronically controlled cut-off switch is a piezo switch, and said cut-off switch comprises, an electric motor.

4. A torque tool as claimed in claim 1, further comprising a cam plate, said gear mechanism acting on said cam plate; said gear mechanism further comprises a gearshift and said at least one gear lever is operated by said gearshift, and a spring biased roll and a ball are provided between said gearshift and said gear lever.

5. A torque tool as claimed in claim 1, further comprising an arrangement for detecting a rotational angle, and an arrangement for cutting-off said torque tool at set value for said rotational angle, and an actuating means for setting said cut-off torque and said cut-off rotational angle respectively.

6. A torque tool as claimed in claim 1, further comprising an optical, acoustic display, a vibrational signal generator, adapted for displaying torque values and alarming at a set torque.

7. A torque tool as claimed in claim 1, further comprising a transmission arrangement for adjusting said set value for a torque and for said transmission of measured data from a distance.

8. A torque tool as claimed in claim 7, wherein said transmission arrangement is selected from a group consisting of: radio transmission, an infrared transmission arrangement, and a cable interface.

9. A torque tool as claimed in claim 1, further comprising a processor for controlling said measuring and controlling electronic arrangement and a storing arrangement for storing a set value, a measured value and a measuring protocol.

10. A torque tool as claimed in claim 1, further comprising a voltage supply arrangement provided within said housing, and an arrangement for comparing an actual value to a set value.

11. A torque tool as claimed in claim 1, further comprising an energy storage arrangement for intermediate storage of energy.

12. A torque tool as claimed in claim 1, wherein said fast discharging electrical device is a fast discharging capacitor.

13. A torque tool as claimed in claim 1, wherein said measuring element is adapted for detecting an actual torque and converting thereof into a corresponding electric signal, said electric signal is directed to said electronic arrangement for processing and detecting the actual torque as an actual value.

14. A torque tool as claimed in claim 1, wherein said electronic arrangement comprises a processor and storage unit, said actual value of the torque determined by said measuring element is compared to a set value which is stored in the processor and storage unit; said comparison of the actual torque value with the set value is carried out by said processor, wherein when the actual torque value and the set value are similar a cut-off signal is generated and directed to said electrical power amplifier for amplification so as to reach a level required to carry out the switching process, said amplified signal is directed to the cut off switch for its activation.

15. A torque tool as claimed in claim 1, further comprises a diverting lever adapted to move about a bearing pin, so as to drive a switching lever about a bearing pin during switching operation, wherein during the switching operation of the cut-off switch a longitudinal lever end of the switching lever is moved by the diverting lever about the bearing pin, a first gear lever biased by a biasing member moves away from the switching lever, so as to cut-off the torque tool.

16. A torque tool as claimed in claim 1, wherein said rod for transmitting the torque is formed with a distal end associated with the workpiece and a proximal end, said proximal end is formed with a step-shaped edge movably cooperating with a step-shaped formation provided at an end of said gear lever facing said rod.

17. A torque tool as claimed in claim 16, wherein said rod for transmitting the torque is movable at a pin disposed at said distal end thereof, said gear lever is movably supported by a bearing pin, wherein said cooperation between the step-shaped edge and the step-shaped formation causes reduction of a distance between the pin of said rod and the bearing pin of the gear lever and reduction of an overall length of the torque tool.

18. A torque tool as claimed in claim 1, wherein said gear mechanism further comprises a switching lever with a head end and an elongated lever end, said switching lever being movable about a bearing pin arranged in the range of the round head end and wherein said round head end is provided with a notch-shaped recess generated by two segments of a circle having different radii thereby forming a switching lever edge engaging with a gear lever.

19. A torque tool as claimed in claim 1, wherein said gear mechanism comprises a switching lever with a head end and an elongated lever end, said switching lever being movable about a bearing pin arranged in the range of the round head end, and wherein a roll and a spring biasing the roll are provided in an opening of said switching lever, said roll engaging with a gear lever.

20. A torque tool as claimed in claim 1, wherein said gear mechanism further comprises a gear shift with a self-locking wedge.

21. A torque tool for measuring cut-off tightening of a torque on a workpiece, comprising:

a housing having a handle;

a rod for transmitting torque;

a measuring element for electronic detection of said torque;

an electronic arrangement for measuring and controlling of processing of said torque detected by said measuring element;

a cut-off switch controlled by said electronic arrangement, said switch carrying out a cutting-off action when said torque reaches a predetermined level;

a gear mechanism having at least one actuator operated by said cut-off switch and at least one gear lever, said gear mechanism is arranged between said rod for transmitting the torque and said electronically controlled cut-off switch;

said rod for transmitting the torque is formed with a distal end associated with the workpiece and a proximal end, said proximal end formed with a step-shaped edge adapted for movable cooperation with a step-shaped formation provided at an end of said gear lever facing said rod; and said measuring element is arranged on said gear lever for electronic detection of said torque during operation of said gear mechanism.

22. A torque tool as claimed in claim 21, wherein said rod for transmitting torque is movable at a pin disposed at said distal end thereof, said gear lever is movably supported by a bearing pin, wherein said cooperation between the step-shaped edge and the step-shaped formation causes reduction of a distance between the pin of said rod and said bearing pin of the gear lever and reduction of an overall length of the torque tool.

* * * * *